US007093312B2

(12) United States Patent
Mossbeck

(10) Patent No.: US 7,093,312 B2
(45) Date of Patent: Aug. 22, 2006

(54) SINGLE MOTOR ADJUSTABLE BED

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/910,061

(22) Filed: Aug. 3, 2004

(65) Prior Publication Data

US 2006/0026763 A1 Feb. 9, 2006

(51) Int. Cl.
*A47B 7/00* (2006.01)

(52) U.S. Cl. ..... 5/613; 5/600; 5/611; 5/616

(58) Field of Classification Search ..... 5/613, 5/617, 618, 616, 600, 611
See application file for complete search history.

(56) References Cited

U.S. PATENT DOCUMENTS

| | | | | | |
|---|---|---|---|---|---|
| 2,560,465 | A | | 7/1951 | McVicker et al. | 74/625 |
| 3,127,783 | A | * | 4/1964 | Martens | 74/89.39 |
| 3,261,639 | A | * | 7/1966 | Phillips | 297/83 |
| 3,317,931 | A | * | 5/1967 | Benoit et al. | 5/616 |
| 3,821,821 | A | | 7/1974 | Bursi et al. | 5/68 |
| 4,385,410 | A | | 5/1983 | Elliott et al. | 5/67 |
| 4,559,655 | A | | 12/1985 | Peck | 5/68 |
| 5,105,486 | A | | 4/1992 | Peterson | 5/611 |
| 5,165,129 | A | * | 11/1992 | Rohm | 5/613 |
| 5,640,730 | A | | 6/1997 | Godette | 5/618 |
| 5,862,551 | A | * | 1/1999 | Oguma et al. | 5/618 |
| 6,000,077 | A | | 12/1999 | Cyr | 5/618 |
| 6,061,852 | A | * | 5/2000 | Bathrick et al. | 5/618 |
| 6,088,853 | A | | 7/2000 | Jansen | 5/618 |
| 6,209,157 | B1 | * | 4/2001 | Hensley | 5/618 |
| 6,230,346 | B1 | | 5/2001 | Branson et al. | 5/618 |
| 6,276,011 | B1 | * | 8/2001 | Antinori | 5/618 |
| 6,351,861 | B1 | * | 3/2002 | Shows et al. | 5/618 |
| 6,389,622 | B1 | * | 5/2002 | Her et al. | 5/600 |
| 6,393,641 | B1 | | 5/2002 | Hensley | 5/618 |
| 6,462,500 | B1 | * | 10/2002 | L'Hegarat et al. | 318/649 |
| 6,499,162 | B1 | | 12/2002 | Lu | 5/618 |
| 6,640,365 | B1 | | 11/2003 | Chang | 5/618 |
| 6,708,358 | B1 | * | 3/2004 | Hensley | 5/915 |
| 6,739,004 | B1 | | 5/2004 | Abrahamsen et al. | 5/610 |
| 6,739,005 | B1 | * | 5/2004 | Davis | 5/615 |
| 6,754,922 | B1 | * | 6/2004 | Dewert | 5/617 |
| 6,789,280 | B1 | * | 9/2004 | Paul | 5/617 |
| 6,839,926 | B1 | * | 1/2005 | Heimbrock et al. | 5/618 |
| 6,907,631 | B1 | | 6/2005 | Heaton | 5/618 |
| 6,951,037 | B1 | * | 10/2005 | Weinman et al. | 5/618 |
| 6,957,460 | B1 | * | 10/2005 | Horitani | 5/618 |
| 6,961,971 | B1 | * | 11/2005 | Schneider et al. | 5/618 |

* cited by examiner

*Primary Examiner*—Suzanne Dino Barrett
*Assistant Examiner*—Jonathan Liu
(74) *Attorney, Agent, or Firm*—Wood, Herron & Evans, LLP

(57) ABSTRACT

An adjustable bed including a stationary frame is supported with legs above a floor. An articulated deck comprising head, seat, leg and foot deck boards hingedly joined together is spaced above the frame with connectors. The connectors include generally inverted U-shaped foot and seat tubes pivotally secured to the frame and secured to the seat and foot deck boards. A motorized drive assembly is operatively coupled to the head deck board and includes arms with are pivotally secured to the frame. Activation of the motorized drive assembly moves the deck boards.

12 Claims, 3 Drawing Sheets

SINGLE MOTOR ADJUSTABLE BED

FIELD OF THE INVENTION

This invention relates generally to adjustable beds and, more particularly, to a motorized adjustable bed having a single motor drive assembly.

BACKGROUND OF THE INVENTION

A well known type of bedding product comprises a motorized adjustable bed in which an articulated frame supports a mattress. These motorized adjustable beds have traditionally been used in hospitals but more and more are being installed and used in residential homes. Motorized articulated beds have conventionally had an upper body support movable between an inclined position in which it supports the patient in a sitting position and a prone position in which the patient lies down in a generally horizontal position. In addition, a leg support is movable between positions and may be adjusted to a desired degree of inclination. An actuating mechanism, commonly two or more electric motors, raises and lowers the head and leg supports of the articulated bed frame. U.S. Pat. No. 5,640,730 discloses such an articulated bed. Disadvantages of adjustable beds incorporating two electric motors over adjustable beds having only one electric motor include 1) the odds of at least one of the motors malfunctioning increases and 2) increased manufacturing costs.

In order to reduce the manufacturing costs of an adjustable bed, adjustable beds have been made with a single motor. U.S. Pat. Nos. 4,385,410 and 4,559,655 discloses such adjustable beds powered by a single motor. Known adjustable beds powered by a single motor require a great deal of power to raise and lower the bed sections to their desired positions due to the weight of the person lying on the bed.

U.S. Pat. Nos. 6,499,162 and 6,640,365 disclose adjustable beds comprising a plurality of bedplates pivotally secured together for supporting a mattress. Connecting elements or links pivotally connect a base to the bed plates. Activation of a power source such as an electric motor causes movement of the bed plates. One disadvantage with the adjustable beds is that the bedplate above the seat of the user does not lower. Consequently, the weight of the person using the bed is not used to move the bedplates.

Therefore, there is a need for an articulated bed powered by a single motor which utilizes a person's weight to activate the bed.

SUMMARY OF THE INVENTION

The invention of this application comprises an adjustable bed having an adjustable deck for supporting a mattress. The adjustable bed is preferably powered by a motorized drive assembly including an electric motor. However, any other drive assembly such as a solenoid may be used in accordance with the present invention.

The adjustable bed comprises a base comprising a stationary frame and supports extending downwardly from the frame to support the frame a fixed distance above the floor or supporting surface. Although legs are preferable, other types of supports may be used in accordance with the present invention to raise the frame off the supporting surface. The frame is generally rectangular having a pair of side rails and a pair of opposed end rails including a head rail and a foot rail at the head and foot ends of the adjustable bed.

An articulated deck for supporting a mattress is spaced above the frame with a plurality of connectors. The articulated deck comprises a head deck board, a seat deck board, a leg deck board and a foot deck board hingedly joined to each other.

The connectors are pivotally secured to the side rails of the frame. More specifically, a pair of generally inverted U-shaped seat tubes or connectors pivotally secured to the side rails of the frame are secured to the seat deck board of the articulated deck. Similarly, a pair of generally inverted U-shaped foot tubes or connectors pivotally secured to the side rails of the frame are secured to the foot deck board of the articulated deck.

A motorized drive assembly is operatively coupled to the head deck board of the articulated deck. The motorized drive assembly functions to move the articulated deck between a first horizontal position in which all of the deck boards are co-planar in a horizontal position and a second fully inclined position in which the head deck board is inclined, the seat deck board generally horizontal, the leg deck board inclined and the foot deck board slightly inclined.

The motorized drive assembly comprises a pair of lever arms of a fixed length pivotally secured to the frame of the articulated bed at one end and secured to support brackets at the other end, the support brackets being secured to the head deck board. An electric motor powered by a control unit is secured to one of the lever arms but may be secured at another location. The motorized drive assembly further comprises a drive tube rotated by the electric motor. Activation of the electric motor rotates the drive tube which moves the head deck board between its first horizontal position and its second inclined position.

In operation, starting from the first position of the articulated bed in which the articulated deck is generally horizontal, an operator activates the motorized drive assembly and leans forwardly. The electric motor rotates the drive tube which causes the lever arms of the drive assembly to rotate or pivot about a horizontal axis at the lower ends of the lever arms i.e. where the lever arms are pivotally secured to the frame. Thus, the head deck board moves from its first horizontal position to its second inclined position. As the head deck board inclines, the seat deck board moves horizontally towards the head end of the bed and also lowers due to the connectors and more particularly, the seat tubes pivoting about horizontal pivot axes. As the seat deck board moves downwardly and towards the head end of the bed, the leg deck board moves from its first horizontal position to its second inclined position. This movement of the leg deck board causes the foot deck board to move towards the head end of the bed as the connectors and in particular the foot tubes are pivoted about horizontal pivot axes.

The configuration of the articulated bed of the present invention allows a user to use his or her weight to move the articulated bed between a first horizontal or prone position to a second inclined position with the assistance of the motorized drive assembly of the articulated bed.

These and other objects and advantages of the present invention will be more readily apparent from the following drawings.

DETAILED DESCRIPTION OF THE DRAWINGS

Figure 1:
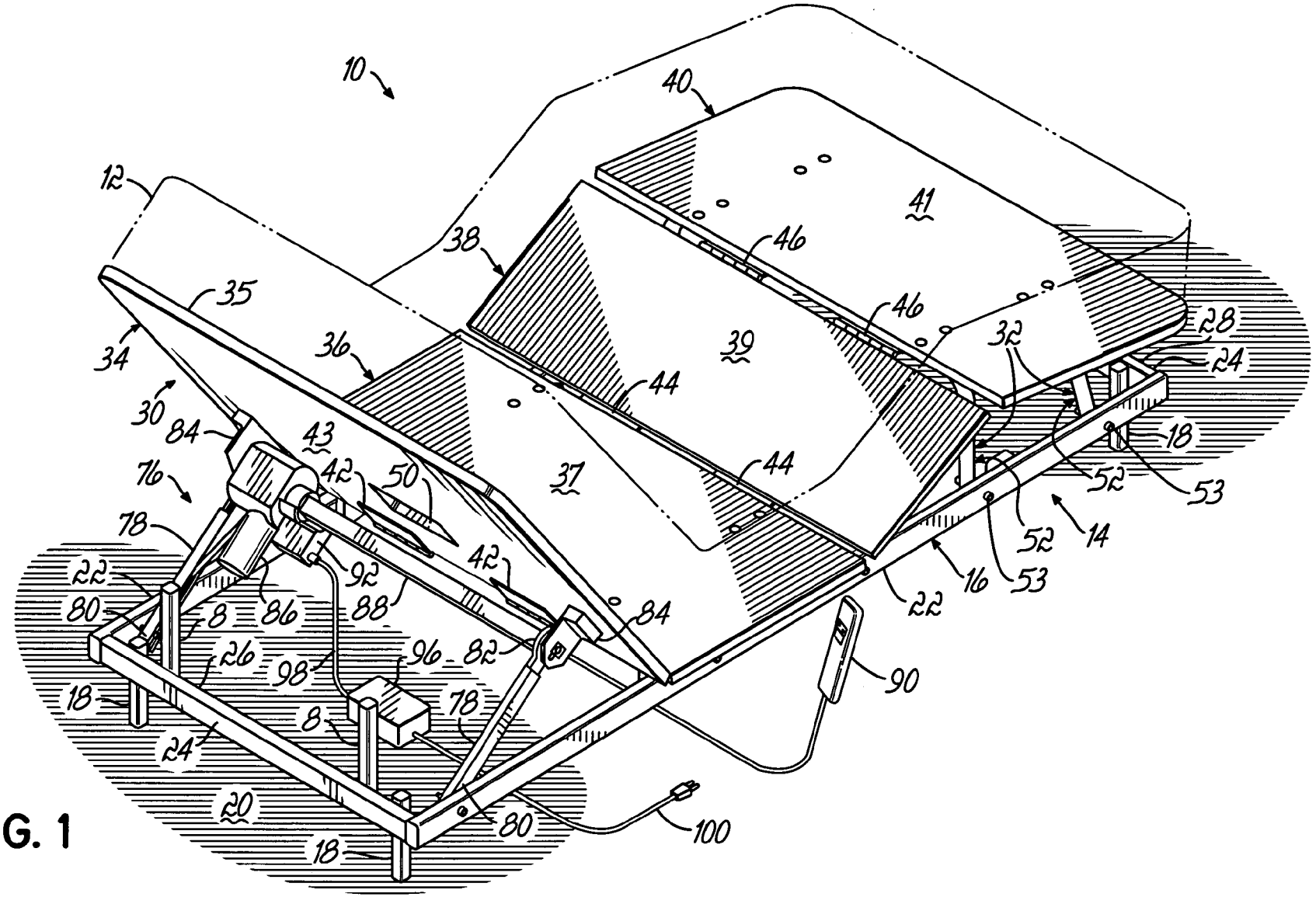
FIG. 1 is a perspective view of an adjustable bed made in accordance with this invention in a fully inclined position supporting a mattress shown in phantom.

Referring to the drawings, and particularly to FIG. 1, there is illustrated an adjustable bed 10 including a mattress 12. The present invention may be used to support any type of mattress including an air mattress, a coil spring mattress or any other type of mattress. The mattress 12 does not form a part of the present invention.

Figure 2:
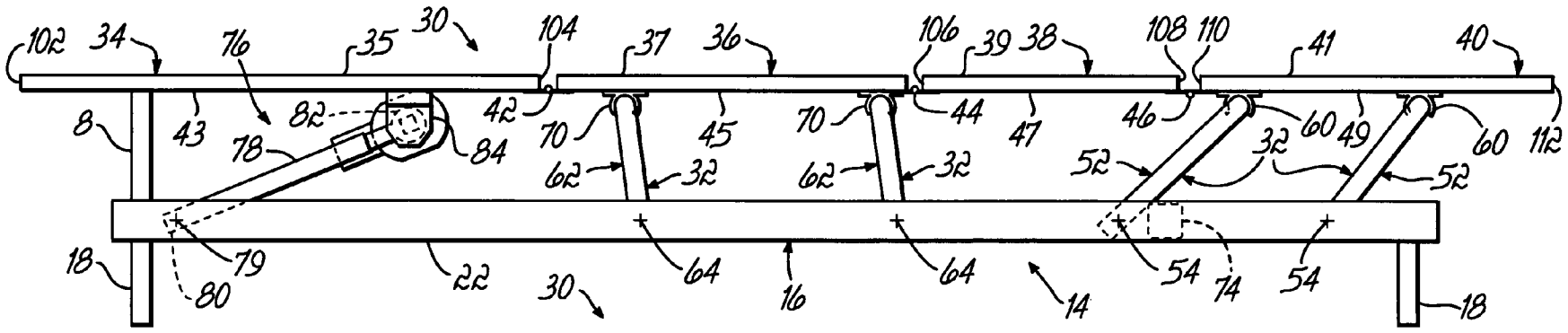
FIG. 2 is a side elevational view of the adjustable bed of FIG. 1 without the mattress in a horizontal position.
Figure 3:
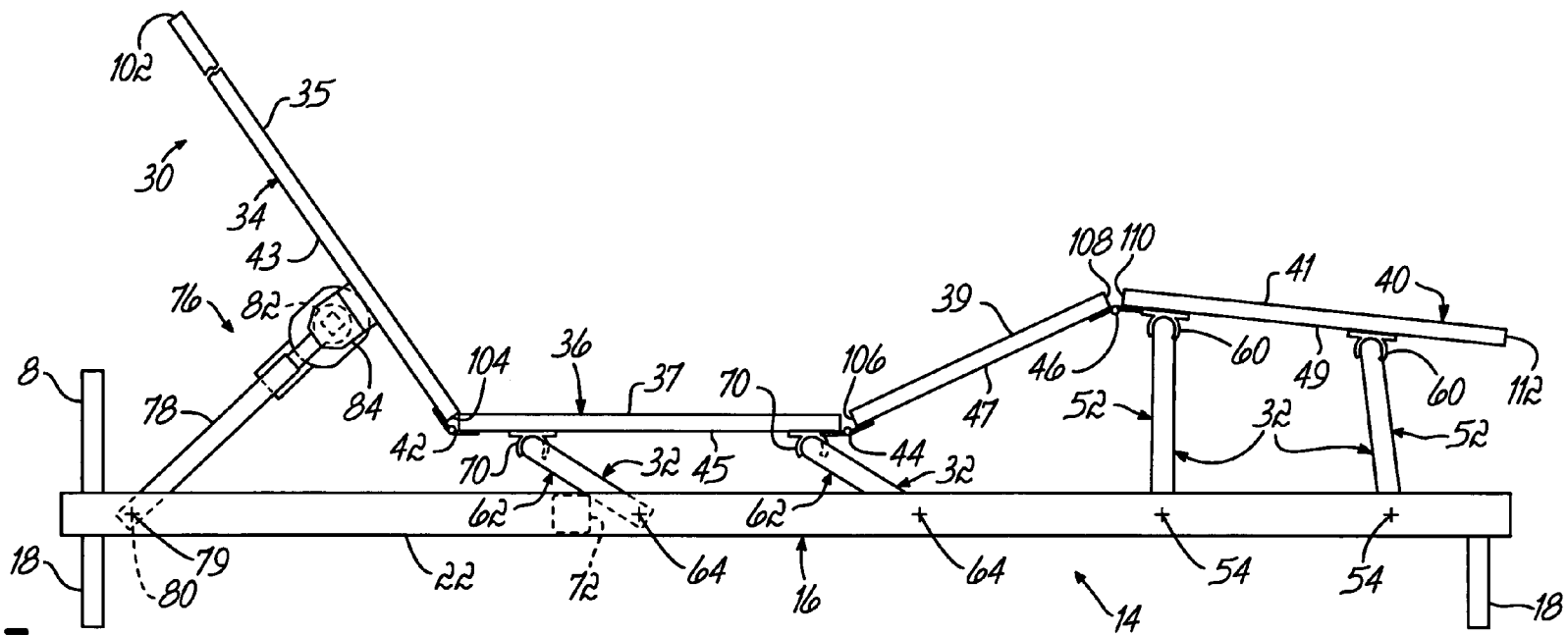
FIG. 3 is a side elevational view of the adjustable bed of FIG. 1 without the mattress in a fully inclined position.

The adjustable bed 10 is movable between a first horizontal position shown in FIG. 2 and a fully inclined position as shown in FIGS. 1 and 3. Typically, an operator or user sleeps with the adjustable bed in its first horizontal position and reads or watches television with the adjustable bed in its fully inclined position.

The adjustable bed 10 comprises a base 14 including a generally rectangular stationary frame 16 and four legs 18 supporting the frame 16 a fixed distance about a floor or supporting surface 20. See FIG. 1. The stationary frame 16 comprises a pair of opposed side rails 22 and a pair of opposed end rails 24 extending between the side rails 22 at the ends thereof. The end rails 24 include a head rail 26 and a foot rail 28. The legs 18 are preferably secured to the end rails 24 but may be secured to the side rails 22 if desired.

An articulated deck 30 is spaced above the stationary frame 16 with a plurality of connectors 32. The articulated deck 30 comprises a head deck board 34, a seat deck board 36, a leg deck board 38 and a foot deck board 40. Each of the deck boards is preferably the same width but any two deck boards may be different widths, if desired. Deck boards 34, 36, 38 and 40 have upper surfaces 35, 37, 39 and 41, respectively, and lower surfaces 43, 45, 47 and 49, respectively. See FIGS. 2 and 3.

Figure 4:
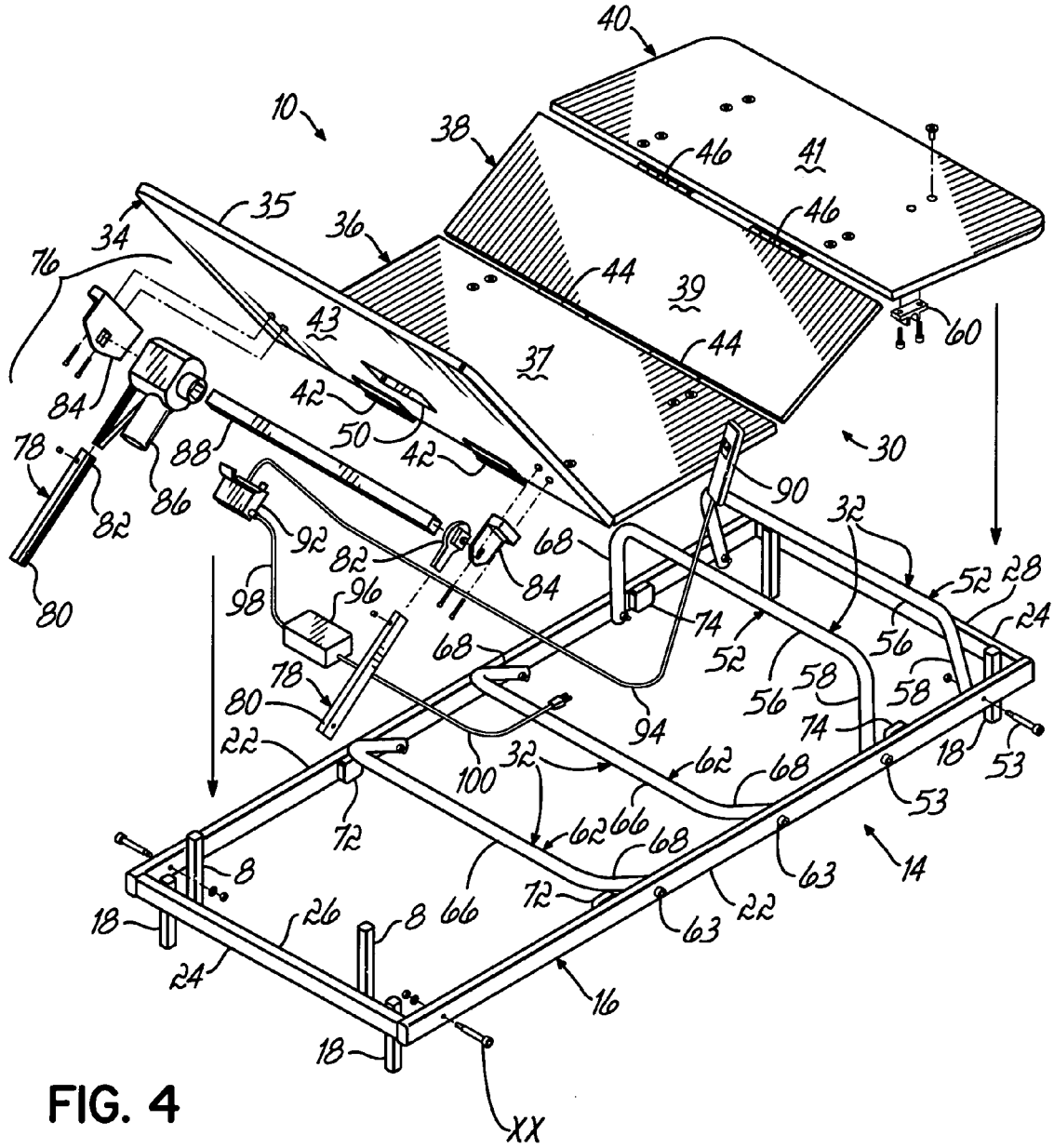
FIG. 4 is a disassembled perspective view of the adjustable bed of FIG. 1 without the mattress.

As best illustrated in FIGS. 2 and 3, the head deck board 34 is hingedly secured to the seat deck board 36 with hinges 42 secured to the lower surfaces 43, 45 of the head and seat deck boards 34, 36, respectively. Similarly, seat deck board 36 is hingedly secured to leg deck board 38 with hinges 44 secured to the lower surfaces 45, 47 of the seat and leg deck boards 36, 38, respectively. Leg deck board 38 is hingedly secured to foot deck board 40 with hinges 46 secured to the lower surfaces 47, 49 of the leg and foot deck boards 38, 40, respectively. Although, two hinges 42 are shown in FIGS. 1 and 4 securing the head deck board 34 to the seat deck board 36, any number of hinges may be used including one continuous hinge. The same applies to hinges 44 and 46 connecting the other deck boards.

The deck boards 34, 36, 38 and 40 are preferably made of plywood, but may be made of plastic, oriented strand board or any other material.

As illustrated in FIGS. 1 and 4, the head deck board 34 has a rectangular hole 50 therein which may be used as a handle.

The adjustable bed 10 further comprises connectors 32 in the form of inverted U-shaped foot tubes 52. As shown in FIG. 4, the adjustable bed 10 has two foot tubes 52 pivotally secured to the side rails 22 of the stationary frame 16 with fasteners 53 so that each pivots about a horizontal pivot axis 54. See FIGS. 2 and 3. Each foot tube 52 has a center portion 56 and a pair of leg portions 58 extending downwardly from opposed ends of the center portion 56. The center portion 56 of each of the foot tubes 52 is secured to the foot deck board 40 with clips 60. As shown in FIG. 4, a pair of clips 60 are secured to the lower surface 49 of the foot deck board 40. Although each foot tube 52 is illustrated being secured to two clips 60, any other means of securing the foot tubes 52 to the foot deck board 40 may be used.

Similarly, two seat tubes or connectors 62 are pivotally secured to the side rails 22 of the stationary frame 16 with fasteners 63 so that each pivots about a horizontal pivot axis 64. See FIGS. 2 and 3. Each seat tube 62 has a center portion 66 and a pair of leg portions 68 extending downwardly from opposed ends of the center portion 66. The center portion 66 of each of the foot tubes 62 is secured to the seat deck board 36 with clips 70. As shown in FIGS. 2 and 3, a pair of clips 70 are secured to the lower surface 45 of the seat deck board 36. Although each seat tube 62 is illustrated being secured to two clips 70, any other means of securing the seat tubes 62 to the seat deck board 36 may be used.

As illustrated in FIG. 4, a pair of stops 72 are secured to the inside surfaces of the side rails 22 of the frame 16 to prevent the seat tubes 62 from moving too far forward i.e. towards the head end of the bed. Similarly, a pair of stops 74 are secured to the inside surfaces of the side rails 22 of the frame 16 to prevent the foot tubes 52 from moving too far rearward i.e. towards the foot end of the bed.

The articulated deck 30 is moved by a motorized drive assembly 76 between a first position shown in FIG. 2 in which the deck boards 34, 36, 38 and 40 are generally co-planar in a horizontal position or orientation and a second position shown in FIG. 3. In the second position, the head deck board 34 is inclined, the seat deck board 36 is substantially horizontal, the leg deck board 36 inclined and the foot deck board 40 slightly inclined.

When the articulated deck 30 is in its first horizontal position shown in FIG. 2, a pair of braces 8 secured to the head rail 26 of the frame 18 and extending upwardly therefrom support the head deck board 34 of the articulated deck 30. See FIG. 2.

The motorized drive assembly 76, shown assembled in FIG. 1 and disassembled in FIG. 4, comprises a pair of lever arms 78 pivotally secured at their lower ends 80 to the side rails 22 of the frame 16 such that each of the lever arms 78 pivots about a horizontal pivot axis 79. See FIGS. 2 and 3. The lever arms 78 are of a fixed length. The upper ends 82 of the lever arms 78 are secured to brackets 84 which are secured to the lower surface 43 of the head deck board 34. An electric motor 86 is secured to one of the lever arms 78 as shown in FIGS. 1 and 4. However, the electric motor 86 may be secured to the head deck board 34 or any other suitable location.

Although any electric motor may be used in accordance with the present invention, one which has proven suitable is manufactured by a German manufacturer Hettich-Franke GmbH under the model number Mosys Classic 1.61.03.

The output of the electric motor 86 drives or rotates a drive tube 88 which extends between the upper ends 82 of the lever arms 78.

The electric motor 86 may be remotely controlled via a remote 90 coupled to a control unit 92 with a line 94. The control unit 92 is powered by a power supply 96 coupled to the control unit 92 via line 98. Cord or line 100 having a plug at the end thereof connects the power supply 96 to a wall outlet (not shown).

In operation, starting from the first position of the articulated bed 10 shown in FIG. 2 in which the articulated deck 30 is generally horizontal, an operator (not shown) activates the motorized drive assembly 76 with the remote 90. Activation of the electric motor 86 rotates the drive tube 88 which causes the lever arms 78 of the drive assembly 76 to rotate or pivot about horizontal axis 79 at the lower ends 80 of the lever arms 78 i.e. where the lever arms 78 are pivotally secured to the side rails 22 of the frame 18. Thus, the head deck board 34 moves from its first horizontal position shown in FIG. 2 to its second inclined position shown in FIG. 3 in which the head edge 102 of the head deck board 34 is above the rear edge 104 of the head deck board 34.

As the head deck board 30 inclines, the person using the bed leans forward causing the rear edge 104 of the head deck board 30 to move towards the head end of the bed, causing or pulling the seat deck board 36 horizontally towards the head end of the bed. The seat deck board 36 also lowers due to the connectors 32 and more particularly, the seat tubes 62 pivoting about horizontal pivot axes 64 in a counterclockwise direction as shown in FIGS. 2 and 3. As the seat deck board 36 moves downwardly and towards the head end of the bed, the leg deck board 38 moves or is pulled from its first horizontal position shown in FIG. 2 to its second inclined position shown in FIG. 3. In this inclined position, the front edge 106 of the leg deck board 38 is lower than the rear edge 108 of the leg deck board 38. This movement of the leg deck board 38 causes or pulls the foot deck board 40 towards the head end of the bed as the connectors 32 and in particular the foot tubes 52 are pivoted about horizontal pivot axes 54 in a counterclockwise direction as viewed in FIGS. 2 and 3. In its inclined position shown in FIG. 3, the front edge 110 of the foot deck board 40 is higher than the rear edge 112 of the foot deck board 40.

As desired, the articulated bed 10 may be moved from its fully inclined position shown in FIG. 3 (in which the front edge 102 of the head deck board 34 is above the rear edge 104 of the head deck board 34) back to its horizontal position shown in FIG. 2 via use of the motorized drive assembly 76 along with the operator shifting his or her weight backwardly.

Although I have described one preferred embodiment of the invention, I do not intend to be limited except by the scope of the following claims.

I claim:

1. An adjustable bed comprising:

a stationary frame having a pair of opposed side rails, a head end rail and a foot end rail;

supports extending downwardly from said frame;

a pair of generally inverted U-shaped foot tubes pivotally secured to said side rails of said frame;

a pair of generally inverted U-shaped seat tubes pivotally secured to said side rails of said frame;

a head deck board;

a seat deck board secured to said seat tubes and hingedly secured to said head deck board;

a leg deck board hingedly secured to said seat deck board;

a foot deck board hingedly secured to said leg deck board and secured to said foot tubes, a motorized drive assembly comprising a pair of lever arms pivotally secured to said side rails of said frame and a motor secured to one of the lever arms for rotating a drive tube extending between the lever arms, said lever arms being operatively coupled to said head deck board, wherein activation of said motorized drive assembly causes movement of said deck boards.

2. The adjustable bed of claim 1 wherein said supports are secured to said end rails of said frame.

3. The adjustable bed of claim 1 wherein activation of said motorized drive assembly moves said head deck board between an inclined position and a horizontal flat position.

4. The adjustable bed of claim 3 wherein said seat deck board moves between a forward position and a rear position upon movement of said head deck board.

5. The adjustable bed of claim 1 further comprising clips secured to said seat deck board and said foot deck board, said foot and seat tubes being secured to said clips.

6. The adjustable bed of claim 1 wherein said lever arms are of a fixed length.

7. The adjustable bed of claim 6 wherein said motor is an electric motor.

8. The adjustable bed of claim 1 wherein said seat deck board moves towards said head end rail and lowers when said head deck board is inclined.

9. The adjustable bed of claim 1 wherein said seat deck board, said leg deck board and said foot deck board each move towards said head end rail when said head deck board is inclined.

10. An adjustable bed comprising:

a stationary frame;

a pair of generally inverted U-shaped foot tubes pivotally secured to said frame;

a pair of generally inverted U-shaped seat tubes pivotally secured to said frame;

a seat deck board secured to said seat tubes;

a foot deck board secured to said foot tubes, a leg deck board hingedly secured to said seat deck board and said foot deck board therebetween;

a head deck board hingedly secured to said seat deck board; and a motorized drive assembly comprising a pair of lever arms pivotally secured to said side rails of said frame and a motor for rotating a drive tube extending between the lever arms and parallel the end rails of the stationary frame, said lever arms being operatively coupled to said head deck board, wherein activation of said motorized drive assembly causes said head deck board to move between an inclined position and a flat position.

11. The adjustable bed of claim 10 wherein said seat deck board, said leg deck board and said foot deck board each move when said head deck board is inclined.

12. The adjustable bed of claim 10 wherein said motor is an electric motor.

* * * * *